US010323633B2

(12) United States Patent
Kochan, Jr.

(10) Patent No.: US 10,323,633 B2
(45) Date of Patent: Jun. 18, 2019

(54) PUMP CONTROL SYSTEM HAVING EMERGENCY RUN MODE

(71) Applicant: Metropolitan Industries, Inc., Romeoville, IL (US)

(72) Inventor: John R. Kochan, Jr., Naperville, IL (US)

(73) Assignee: METROPOLITAN INDUSTRIES, INC., Romeoville, IL (US)

( * ) Notice: Subject to any disclaimer, the term of this patent is extended or adjusted under 35 U.S.C. 154(b) by 458 days.

(21) Appl. No.: 14/452,792

(22) Filed: Aug. 6, 2014

(65) Prior Publication Data

US 2015/0044060 A1 Feb. 12, 2015

Related U.S. Application Data

(60) Provisional application No. 61/863,138, filed on Aug. 7, 2013.

(51) Int. Cl.

| | |
|---|---|
| ***F04B 49/02*** | (2006.01) |
| ***F04B 49/06*** | (2006.01) |
| ***F04B 49/10*** | (2006.01) |

(52) U.S. Cl.

CPC ..... *F04B 49/10* (2013.01); *F04B 49/02* (2013.01); *F04B 49/06* (2013.01)

(58) Field of Classification Search

CPC ..... F04B 49/02; F04B 49/022; F04B 49/025; F04B 49/06; F04B 49/065; F04B 49/10

USPC ..... 417/36, 38, 40, 41, 44.1, 44.11

See application file for complete search history.

(56) References Cited

U.S. PATENT DOCUMENTS

| | | | | |
|---|---|---|---|---|
| 3,814,544 A * | 6/1974 | Roberts | F04B 49/025 | 417/40 |
| 6,186,743 B1 * | 2/2001 | Romer | F04B 41/06 | 361/191 |
| 2009/0148306 A1 * | 6/2009 | Drechsel | F04B 49/02 | 417/36 |
| 2013/0197700 A1 * | 8/2013 | Kochan, Jr. | F04B 49/065 | 700/282 |

* cited by examiner

*Primary Examiner* — Philip E Stimpert

(74) *Attorney, Agent, or Firm* — Husch Blackwell LLP; George S. Pavlik

(57) ABSTRACT

A pump control system receives inputs from a low level fluid level sensor and a high level fluid level sensor. Based on inputs from the sensors, and in response to sensed trouble conditions, duplex pumping or pump specific simplex operation is restricted based on past and present pump current draws.

12 Claims, 4 Drawing Sheets

* PUMP AVAILABILITY CONTINUALLY CHECKED BY CURRENT PROTECTION FEATURE

PUMP CONTROL SYSTEM HAVING EMERGENCY RUN MODE

CROSS-REFERENCE TO RELATED APPLICATION

This application claims the benefit of the filing date of U.S. Provisional Application Ser. No. 61/863,138 filed Aug. 7, 2013, entitled, "Pump Control System Having Emergency Run Mode". The '138 application is hereby incorporated herein by reference.

FIELD

The application pertains to control systems which sense water levels at a predetermined location and activate one or more pumps. More particularly, the application pertains to such control systems wherein, in response to sensed trouble conditions, duplex pumping or pump specific simplex operation is restricted based on past and present current draw.

BACKGROUND

Systems are known to sense water levels at predetermined locations, and in response thereto, activate one or more pumps to control the water level. In this regard, one or two pumps can be activated. While useful, known systems can suffer from sensor or motor failures which can produce an undesirable flood condition.

DETAILED DESCRIPTION

Figure 1:
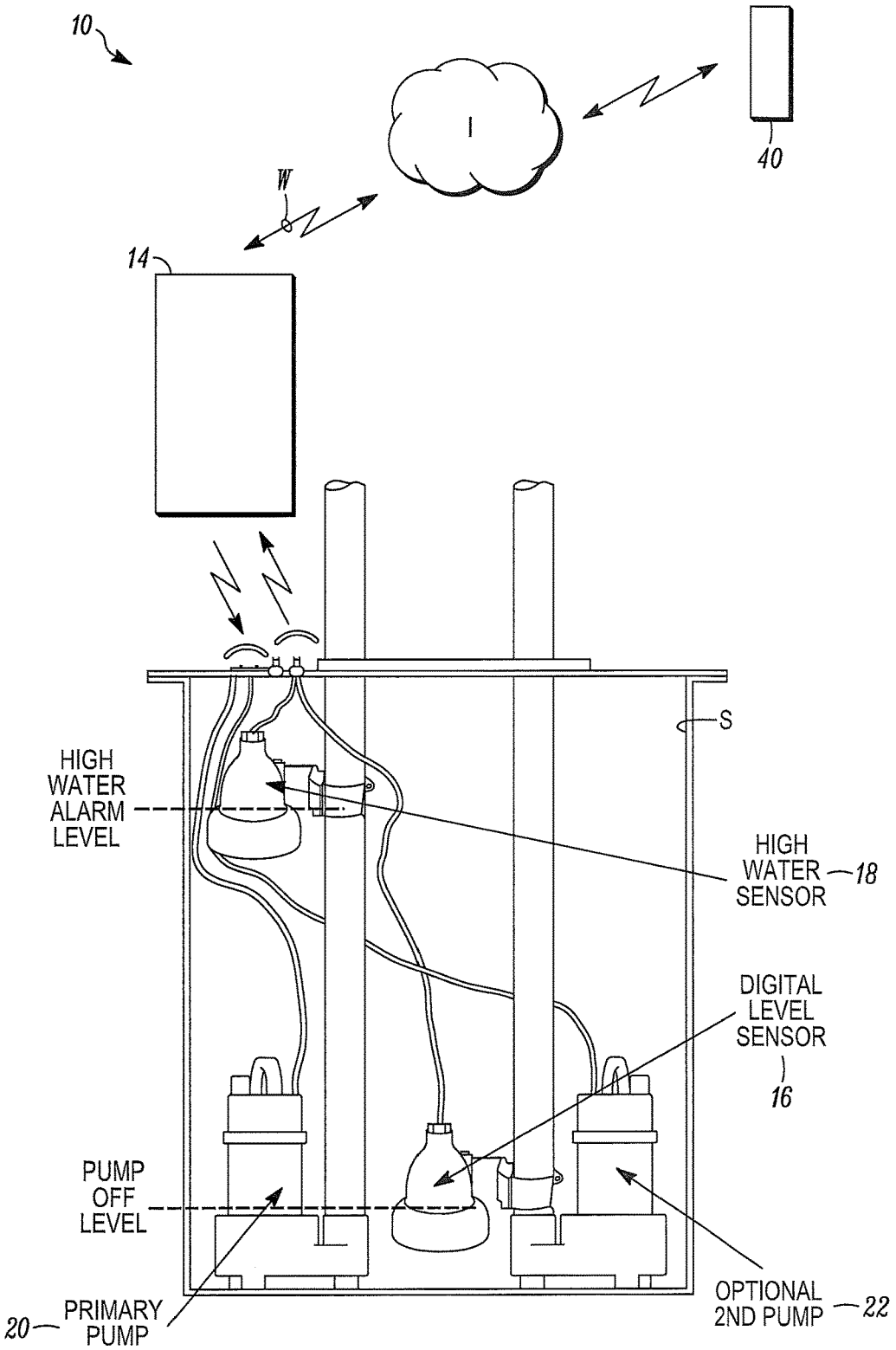
FIG. 1 illustrates a system configuration in accordance herewith.

While disclosed embodiments can take many different forms, specific embodiments thereof are shown in the drawings and will be described herein in detail with the understanding that the present disclosure is to be considered as an exemplification of the principles thereof as well as the best mode of practicing same, and is not intended to limit the application or claims to the specific embodiment illustrated.

A pump controller in accordance herewith senses a water level of up to a predetermined depth. To control or reduce the water level, embodiments hereof include a configurable water level/pump turn-on setting, the ability to run two pumps simultaneously, pump alternation, pump failure sensing, local audible/visual alarm notification, local alarm silencing, and remote alarm notification. Locations of use include sumps in residential or commercial buildings without limitation.

In one embodiment, an Ethernet module can provide a web page interface that displays system information and alarm notification remotely via email and text messages. Local outputs at the controller can include a display of local conditions, an LED-type display, as well as an audio alarm or a contact closure to provide immediate, and direct feedback to a user.

First and second water sensors can be coupled to the controller. A lower sensor is intended to be installed at a lower or bottom water level. In normal operation, that sensor will cause a running pump to turn off when the water level is low enough. The same sensor can cause the pump to turn on when the water level increases to a preset level. The second sensor is intended to be installed at a location higher than the first sensor, relative to the water level, to provide a high water alarm level.

Embodiments hereof can operate in several different operating modes with one or two pumps. In a duplex alternating mode, the controller will run one or two pumps simultaneously in response to local water conditions. In a simplex alternating operating mode, two pumps are available but they will not be energized simultaneously.

Under any of the following conditions, the controller will enter a state of alarm. These include, detection of a pump failure, the water level reaching the second or high level sensor, or a failure of a lower water level sensor. Additionally where a pump has been continuously running but the water level remains above the lower level sensor for a predetermined period of time, embodiments hereof will enter the alarm state.

Once in an alarm state, the controller can notify the user that there may be trouble by initiating audible and visual cues, breaking (electrically opening) the remote alarm contacts which can be connected to another alarming device, allowing it to inform the user remotely (these contacts are normally closed). Additionally, the controller can communicate the alarm to an optional internal alarm module, or externally via wireless communications for further handling.

If the first, or lower level sensor (DLS) connected to the controller is disconnected, faulted, or has otherwise failed while the controller is operating with the second, higher level, sensor installed the controller enters an "Emergency Run", or SOS, mode. In this mode, once the higher level sensor (HLS) reads a water level>=a min_threshold for a certain period of time, the controller then will begin the process of starting all available pumps one at a time with minimum time delays between starts.

Pump(s) will remain energized until the high level sensor reads a water level<an off threshold for predetermined period of time. Then the pump(s) will be turned off one at a time with minimum time delay in between off intervals. If two pumps are available and not previously locked out by the current protection processing, duty cycle alternation will occur once the lead pump (first pump started) turns off.

Since the characteristics of a wide variety of pumps, pit depths and pump sizes need to be addressed and cannot be predicted, if the lower level sensor has failed, the controller has no lower water level off signal. Hence, in accordance with embodiments hereof, an emergency run mode is provided which causes pumping to occur at user defined time intervals once the second, or higher level sensor has been activated.

In another aspect, if both water, or fluid, sensors connected to the controller are disconnected, faulted, or otherwise fail, the controller enters an "SOS" mode where an available pump is run for a predetermined time period and then turned off for different time period. If two pumps are installed and not previously locked out by the current protection processing, the controller will alternate pumps based upon a predetermined duty cycle.

For example, the controller's "SOS" mode can set to run a pump for thirty seconds and then turn it off for ninety seconds. If two pumps are installed and available: pump1 can be set to run for thirty seconds, then pump1 will turn off.

After ninety seconds pump2 can start and run for thirty seconds, then pump2 will turn off. After ninety seconds pump1 starts and the cycle repeats indefinitely.

In yet another aspect, the present method maintains some level of pumping operation while minimizing possible adverse effects on the pumps (due to pumping dry) when the controller has lost all sensors and is "flying blind" in terms of level based control. In embodiment's hereof, the "SOS" mode pumps and attempts to avoid flooding while trying to keep wear and tear on the pumps to a minimum.

Figure 2:
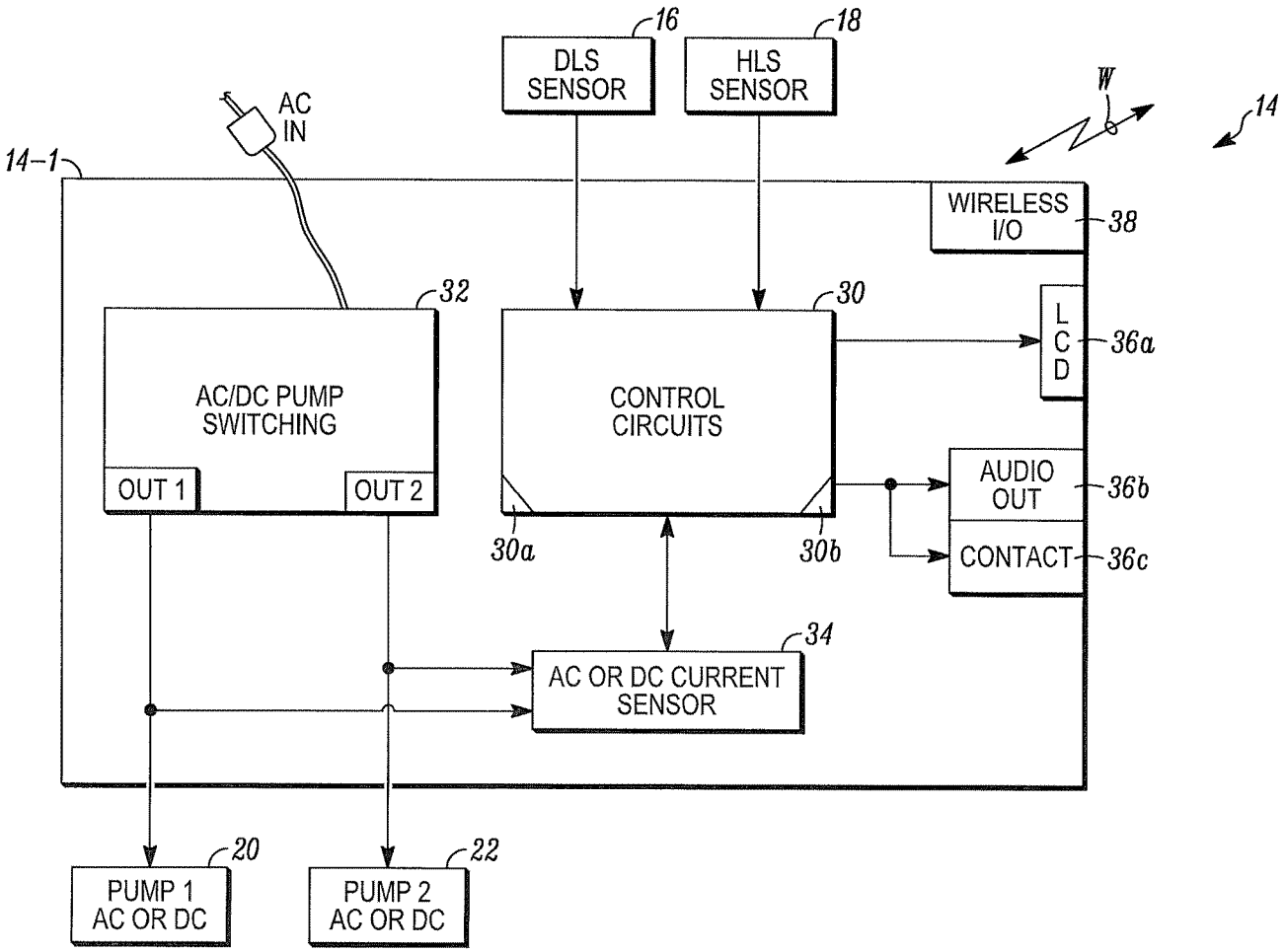
FIG. 2 illustrates a block diagram of a controller in accordance herewith.

FIGS. 1, 2 illustrate aspects of a system 10 in accordance herewith. The system 10, discussed below, can implement some or all of the aspects discussed above. As those of skill will understand, variations of the above described processing come within the spirit and scope hereof.

System 10 includes a controller 14 which can be coupled by cables to a lower sensor 16, a high water alarm level sensor 18, and two pumps, 20, 20. Pumps can have AC or DC motors without limitation. In FIG. 1, the level sensors 16, 18 and pumps 20, 22 are illustrated installed in a sump S in which water collects.

Controller 14 carries in housing 14-1 control circuits 30 which can be implemented in part with one or more processors 30*a* and associated, executable, control software 30*b*. The control circuits 30 are coupled to AC/DC switching element 32 which can selectively, in response to control circuits 30 deliver AC/DC electrical energy to one or both of pumps 20, 22.

Control circuits 30 are also coupled to incoming signals from sensors 16, 18 as well as pump motor current sensor 34. Output devices display 36*a*, audio alarm 36*b*, contact closure 36*c*, as well as wireless interface 38 provide communications to users locally or displaced from the controller 14. The interface 38 can communicate wirelessly via wireless medium W, and a computer network, such as the internet I with a user's wireless phone, tablet or computer 40 to provide updates as well as receive instructions for settings of the control circuits 30.

Figure 3:
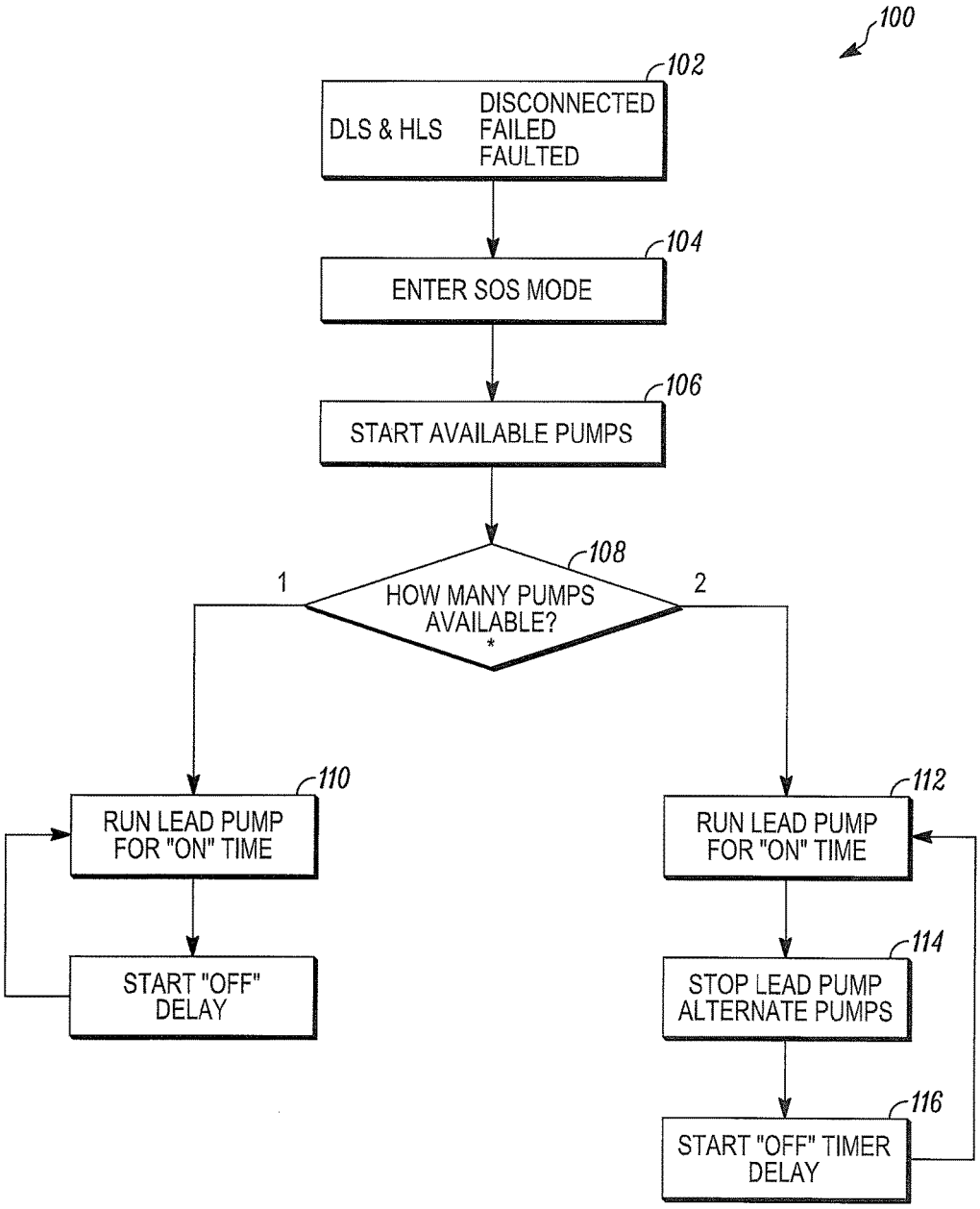
FIG. 3 is a flow chart illustrating an operational method in accordance herewith.
Figure 4:
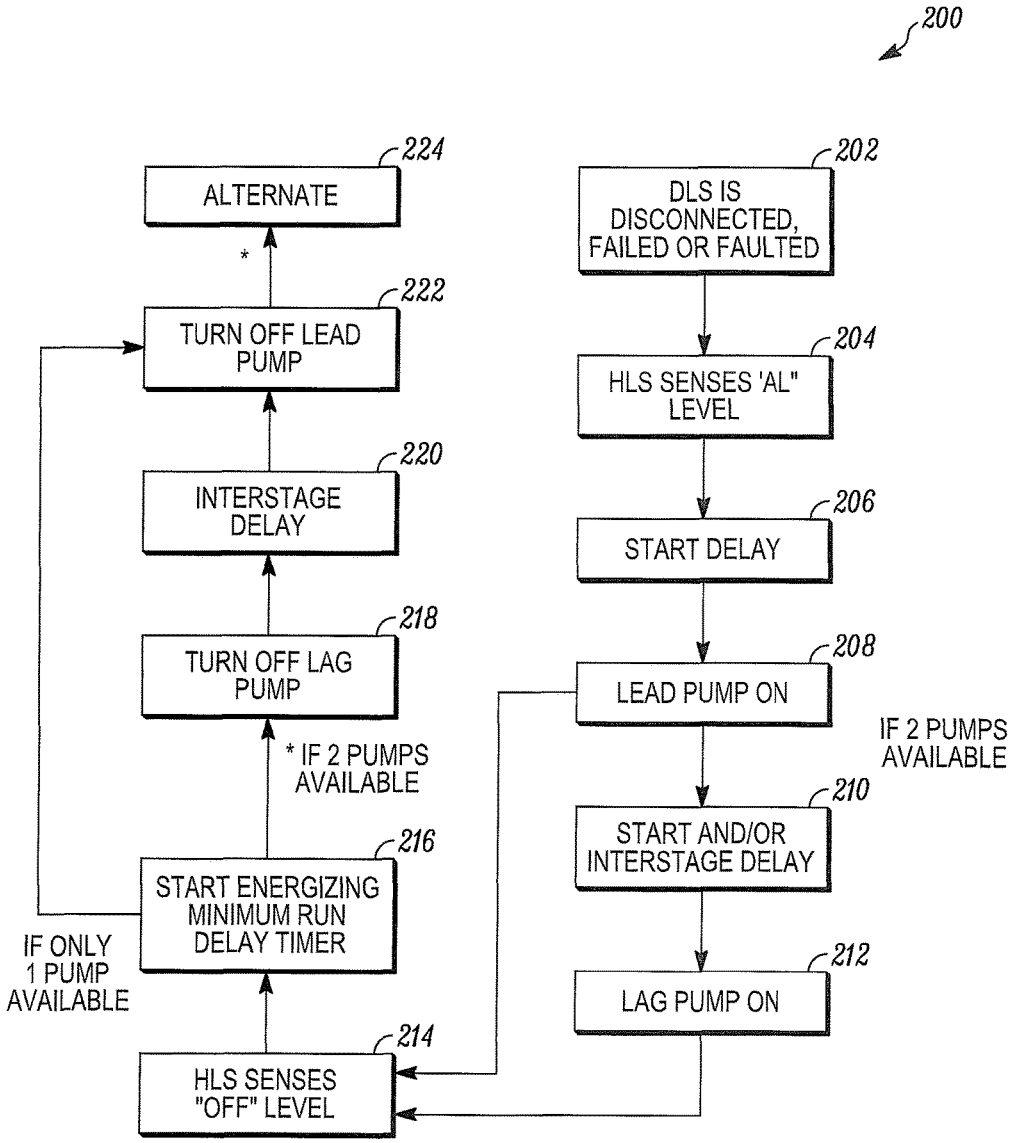
FIG. 4 is a flow chart illustrating another operational method in accordance herewith.

FIGS. 3,4 illustrate aspects of processing by controller 14, without limitation. Process 100, of FIG. 3, illustrates operation in response to detecting that either the first or second sensors, DLS, or HLS have exhibited disconnection, failure or faulting, as at 102. In response thereto, controller 14 enters the SOS operational mode as at 104. Available pump(s) are started as at 106.

A determination is made as to the number of available pumps, as at 108. The number of available pumps can be continually checked by controller 14 using the pump motor current sensor 34.

If a single pump is available, it is operated in a simplex non-alternating mode, as at 110. Where two pumps are available, they are operated in a simplex alternating mode. The lead pump is energized for a predetermined "on" time, for example, thirty seconds, as at 112. Subsequent to the "on" time, the operating pump is turned off, and the pumps are alternated so that the other one becomes the lead pump in the next cycle. An "off" timer is then started, for example 90 seconds, as at 116, and the process returns to 112 for the next cycle.

In both of the above modes of FIG. 3, the energized pump has the full outlet current available since only one pump at a time is activated. Unlike the above, FIG. 4 illustrates a duplex alternating pump control process 200, an emergency run mode, which uses two pumps which can be simultaneously run using available current from the electrical outlet to which controller 14 is connected. Alternately, a separate feed can be provided to energize the pumps without departing from the spirit and scope hereof.

Process 200 is executed where the controller 14 determines that the lower sensor 16, DLS is disconnected, has failed or faulted, as at 202. Where the high level sensor 18, HLS, provides a signal of a high water alarm level, as at 204, a delay is started, for example thirty seconds, as at 206. Subsequent to the delay the lead pump, one of 20, 22, is energized, as at 208.

Where two pumps are available, a second delay can initiated as at 210. Subsequently the lag pump, the other of 20, 22, can be energized as at 212. At this time, both pumps are running.

Both pumps continue to run until the high level sensor 18 signals that the fluid level has fallen to or below the alarm level, as at 214. Where two pumps are available, a minimum run delay timer is started, as at 216. Both pumps continue to run during this delay time.

Subsequently, at 218 the lag pump is turned off, while the lead pump continues to run. After a further delay, as at 220, the second, or lead pump, is turned off as at 222. The pumps can be alternated as at 224. The emergency run mode of FIG. 4 operates to keep the high level water in the sump S in the absence of a low level signal while at the same time avoiding a condition where the pumps are running dry because the sump has been pumped out. Unless the high level sensor sensing the high water alarm level, the process 200 will not be executed.

In addition to sensing and evaluating signals from the two level sensors, 16, 18 the controller 14 can detect pump motor failures. Pump motor condition can be evaluated by circuits 30 using the motor current sensor 34. Whenever a pump draws an abnormal current, the controller can detect it and then in response thereto enter an alarm state indicating to the user that pump servic 4 is needed.

The following three Tables illustrate these conditions for various modes of operation as discussed above. An "X" in a column indicates that an action or state has occurred at the respective entry.

Table 1 illustrates aspects of duplex operation, process 200, where both pumps 20, 22 are intended to run simultaneously when required. Table 2 illustrates aspects of alternating simplex operation as illustrated in process 100 where two pumps 20, 22 are present. Table 3 illustrates aspects of non-alternating simplex operation with only one installed pump.

TABLE 1

Duplex Operation-2 pumps installed; both intended to run simultaneously when required.

| Number of Pumps Running | Current | Duplex Pumping Locked Out* | Duplex Pumping Forced Off† | Pump Locked Out | Pump Bad‡ | Alternate To Next Pump | Beep | Open Remote Alarm Contacts | LCD Updates |
|---|---|---|---|---|---|---|---|---|---|
| 2 | Extreme | X | X | | | | X | X | X |
| | High, 3 Times | X | X | | | | X | X | X |
| | High | | X | | | | | X | X |
| | Low | | | | | | X | X | X |

TABLE 1-continued

| Duplex Operation-2 pumps installed; both intended to run simultaneously when required. | | | | | | | | | |
|---|---|---|---|---|---|---|---|---|---|
| Number | | Duplex Pumping | Duplex Pumping | Pump | | Alternate | | Open Remote | |
| of Pumps Running | Current | Locked Out* | Forced Off† | Locked Out | Bad‡ | To Next Pump | Beep | Alarm Contacts | LCD Updates |
| 1 | Critical | N/A | N/A | X | | X | X | X | X |
| | Extreme, 3 Times | N/A | N/A | | X | X | X | X | X |
| | Extreme | N/A | N/A | | | X | | X | X |
| | High, 3 Times | N/A | N/A | | | | | X | X |
| | High | N/A | N/A | | | | | X | X |
| | Low | N/A | N/A | | | X | X | X | X |

TABLE 2

| Alternating, Simplex Operation-2 pumps installed, only one pump intended to run at one time. | | | | | | | |
|---|---|---|---|---|---|---|---|
| Number | | Pump | | Alternate | | Open Remote | LCD |
| of Pumps Running | Current | Locked Out* | Bad‡ | To Next Pump | Beep | Alarm Contacts | Up-dates |
| 1 | Extreme | X | | X | X | X | X |
| | High, 3 Times | X | | X | X | X | X |
| | High | | X | X | X | X | X |
| | Low | | | X | X | X | X |

TABLE 3

| Non-Alternating, Simplex Operation-pump installed, only pump 1 will run. Pump 2 is disabled. | | | | | | |
|---|---|---|---|---|---|---|
| Number of Pumps | | Pump | | | Open Remote | LCD Up- |
| Running | Current | Locked Out* | Bad‡ | Beep | Alarm Contacts | dates |
| 1 | Extreme | X | | X | X | X |
| | High, 3 Times | X | | X | X | X |
| | High | | X | X | X | X |
| | Low | | | X | X | X |

*Duplex Pump Mode or pump is permanently locked out from running until controller is reset.
†Running two pumps simultaneously is temporarily disabled; that is, one pump is turned off.
‡Pump is only run as a lag (secondary) pump.

In summary, as described above, duplex pumping, or pump specific simplex operation is restricted based on past and present current draws to avoid tripping circuit breakers and to keep the pump(s) running as long as possible. As described above, when both the digital level sensor (DLS) and high level sensor (HLS) are disconnected, failed or faulted, the controller enters the SOS mode. The number of pumps available to the controller is subject to the configuration of the controller and associated current protection feature, or processing.

The current protection processing continually checks the health of the pump(s). If one or both of the pumps are deemed locked, failed or faulted, the respective pump(s) is/are no longer available to the controller for operation. If either the DLS sensor or the HLS sensor are reconnected, the controller will exit the SOS mode and resume normal operation.

From the foregoing, it will be observed that numerous variations and modifications may be effected without departing from the spirit and scope hereof. It is to be understood that no limitation with respect to the specific apparatus illustrated herein is intended or should be inferred. It is, of course, intended to cover by the appended claims all such modifications as fall within the scope of the claims. Further, logic flows depicted in the figures do not require the particular order shown, or sequential order, to achieve desirable results. Other steps may be provided, or steps may be eliminated, from the described flows, and other components may be add to, or removed from the described embodiments.

The invention claimed is:

1. A system comprising:

a pump controller;

one or more pumps coupled to the controller;

a first water level sensor coupled to the controller;

a second water level sensor coupled to the controller, the second water level sensor being installed in a location above the first water level sensor;

wherein, in response to detection of at least one of disconnection, fault, or failure exhibited by the first water level sensor and a signal of a high water alarm level being provided by the second water level sensor the controller enters an emergency mode, wherein the controller determines an available number of the one or more pumps, wherein, when the available number of the one or more pumps is one and the controller is operating in the emergency mode, the controller operates a single pump of the one or more pumps in a simplex non-alternating mode wherein the single pump is activated, a signal is received from the second water level sensor that a water level has fallen below the high water alarm level, a minimum run delay timer is activated in response to the signal being received that the water level has fallen below the high water alarm level, and the single pump is deactivated following expiration of the minimum run delay timer, wherein, when the available number of the one or more pumps is two and the controller is operating in the emergency mode, the controller, operates a first pump and a second pump of the one or more pumps in a duplex alternating mode wherein a lead pump of the one or more pumps is activated, a first interstage delay timer is activated following activation of the lead pump, a lag pump is activated following expiration of the first interstage delay timer, a signal is received from the second water level sensor that the water level has fallen below the high water alarm level, the minimum run delay timer is activated in response to the signal being received that the water level has fallen below the high water alarm level, the lag pump is deactivated following expiration of the minimum run delay timer, a second interstage delay timer is activated after deactivating the lag pump, and the lead pump is deactivated after expiration of the second interstage delay timer, wherein, when the first pump is designated as the lead pump and the second pump is designated as the lag pump, the controller reassigns the first pump as the lag pump and the second pump as the lead pump following the lead pump being deactivated after expiration of the second interstage delay timer, and wherein, when the second pump is designated as the lead pump and the first pump is designated as the lag pump, the controller reassigns the second pump as the lag pump and the first pump as the lead pump following the lead pump being deactivated after expiration of the second interstage delay timer.

2. A system as in claim 1 which includes at least one pump current sensor wherein the controller adjusts operation of the one or more pumps in real-time in response to signals from the current sensor.

3. A system as in claim 2 wherein, the controller determines the available number of pumps using the signals from the current sensor.

4. A system as in claim 1 further comprising an alarm output device, the alarm output device being at least one of an electronic display for presenting a visual indication of an alarm, or an audio alarm.

5. A system as in claim 1 further comprising a wireless input/output interface configured for wireless communication with a remote electronic device via a computer network.

6. A system as in claim 1 wherein the controller is further operable in a SOS mode in response to detection of at least one of a disconnection, fault or failure of both the first and second water level sensors;

wherein all available pumps of the one or more pumps are started when the control begins operating in the SOS mode;

wherein, when the available number of the one or more pumps is one and the controller is operating in the SOS mode, the controller, after determining the available number of the one or more pumps, switches to operating the single pump of the one or more pumps in a second simplex non-alternating mode wherein the single pump is operated for a predetermined on time, the single pump is deactivated following expiration of the predetermined on time, an off delay of a predetermined off time is activated upon deactivation of the single pump, and the single pump is reactivated following expiration of the predetermined off time;

wherein, when the available number of the one or more pumps is two and the controller is operating in the SOS mode, the controller, after determining the available number of the one or more pumps, switches to operating a first pump and a second pump of the one or more pumps in a simplex alternating mode wherein the first pump is designated as a the lead pump and is activated for the predetermined on time, the lead pump is deactivated following expiration of the predetermined on time, the lead pump designation is alternated to the second pump following expiration of the predetermined on time, an off delay of a predetermined off time is started, and the second pump designated as the lead pump is activated following expiration of the predetermined off time.

7. A system comprising:

a pump controller;

at least two pumps including a first and second pump coupled to the controller;

a first water level sensor coupled to the controller;

a second water level sensor coupled to the controller, the second water level sensor being installed in a location above the first water level sensor;

wherein, in response to detection of at least one of disconnection, fault, or failure exhibited by the first water level sensor and a signal of a high water alarm level being provided by the second water level sensor the controller enters an emergency mode, wherein the controller determines an available number of the at least two pumps, wherein, when the available number of the at least two pumps is two and the controller is operating in the emergency mode, the controller, operates a first pump and a second pump of the at least two pumps in a duplex alternating mode wherein a lead pump of the at least two pumps is activated, a first interstage delay timer is activated following activation of the lead pump, a lag pump of the at least two pumps is activated following expiration of the first interstage delay timer, a signal is received from the second water level sensor that a water level has fallen below the high water alarm level, a minimum run delay timer is activated in response to the signal being received that the water level has fallen below the high water alarm level, the lag pump is deactivated following expiration of the minimum run delay timer, a second interstage delay timer is activated after deactivating the lag pump, and the lead pump is deactivated after expiration of the second interstage delay timer, wherein, when the first pump is designated as the lead pump and the second pump is designated as the lag pump, the controller reassigns the first pump as the lag pump and the second pump as the lead pump following the lead pump being deactivated after expiration of the second interstage delay timer, and wherein, when the second pump is designated as the lead pump and the first pump is designated as the lag pump, the controller reassigns the second pump as the lag pump and the first pump as the lead pump following the lead pump being deactivated after expiration of the second interstage delay timer.

8. A system as in claim 7 which includes at least one pump current sensor wherein the controller adjusts operation of the at least two pumps in real-time in response to signals from the current sensor.

9. A system as in claim 8 wherein, the controller determines the available number of pumps using the signals from the current sensor.

10. A system as in claim 7 further comprising an alarm output device, the alarm output device being at least one of an electronic display for presenting a visual indication of an alarm, or an audio alarm.

11. A system as in claim 7 further comprising a wireless input/output interface configured for wireless communication with a remote electronic device via a computer network.

12. A system as in claim 7 wherein the controller is further operable in a SOS mode in response to detection of at least one of a disconnection, fault or failure of both the first and second water level sensors;

wherein all available pumps of the at least two pumps are started when the control begins operating in the SOS mode;

wherein, when the available number of the at least two pumps is two and the controller is operating in the SOS mode, the controller, after determining the available number of the at least two pumps, switches to operating the first and second pumps in a simplex alternating mode wherein the first pump is designated as the lead pump and is activated for a predetermined on time, the lead pump is deactivated following expiration of the predetermined on time, the lead pump designation is alternated to the second pump following expiration of the predetermined on time, an off delay of a predetermined off time is started, and the second pump designated as the lead pump is activated following expiration of the predetermined off time.

* * * * *